US009032856B2

(12) United States Patent
Barlow et al.

(10) Patent No.: US 9,032,856 B2
(45) Date of Patent: May 19, 2015

(54) TRAINABLE LAUNCHER

(71) Applicant: Chemring Countermeasures Limited, Wiltshire (GB)

(72) Inventors: Andrew Charles Barlow, Wiltshire (GB); Commodore Richard J. Lord, Wiltshire (GB)

(73) Assignee: Chemring Countermeasures Limited, Fareham (GB)

( * ) Notice: Subject to any disclaimer, the term of this patent is extended or adjusted under 35 U.S.C. 154(b) by 0 days.

(21) Appl. No.: 13/948,627

(22) Filed: Jul. 23, 2013

(65) Prior Publication Data

US 2015/0107446 A1 Apr. 23, 2015

Related U.S. Application Data

(63) Continuation of application No. 12/800,982, filed on May 26, 2010, now Pat. No. 8,490,532.

(30) Foreign Application Priority Data

Aug. 5, 2009 (GB) ..... 0913637.5
Mar. 11, 2010 (GB) ..... 1004080.6

(51) Int. Cl.
*F41F 1/08* (2006.01)

(52) U.S. Cl.
CPC ..... *F41F 1/08* (2013.01)

(58) Field of Classification Search
CPC ..... F41F 3/00; F41F 3/04; F41F 5/00; F41F 7/00; F41F 1/00; F41F 1/06; F41F 1/08; F41F 1/10; F41A 23/00; F41A 23/24; F41A 99/00; F41H 11/02; F41G 5/00; F41G 5/02
USPC ..... 89/1.41, 1.815, 1.816, 37.14, 37.01, 89/37.02, 37.05, 37.22, 163, 160, 161, 89/162, 13.1, 38, 39, 41.16, 1.1, 1.35, 89/1.819, 126, 1.8; 102/352, 360
See application file for complete search history.

(56) References Cited

U.S. PATENT DOCUMENTS

| | | | | | |
|---|---|---|---|---|---|
| 33,944 | A | * | 12/1861 | Hopkins | 89/39 |
| 665,816 | A | * | 1/1901 | Walker | 89/38 |
| 1,394,083 | A | * | 10/1921 | Griffiths | 89/37.02 |
| 2,770,169 | A | * | 11/1956 | Gerdin | 89/1.1 |
| 3,106,132 | A | * | 10/1963 | Biermann et al. | 89/1.815 |
| 3,733,606 | A | * | 5/1973 | Johansson | 342/3 |
| 4,064,305 | A | * | 12/1977 | Wallin | 442/308 |
| 4,233,882 | A | * | 11/1980 | Eichweber | 89/1.41 |
| 4,681,013 | A | * | 7/1987 | Farley et al. | 89/1.815 |
| 5,020,412 | A | * | 6/1991 | Adams | 89/1.805 |

(Continued)

FOREIGN PATENT DOCUMENTS

| | | | | | |
|---|---|---|---|---|---|
| WO | WO 9849513 | A1 | * | 11/1998 | F41F 1/06 |
| WO | WO 2009000380 | A1 | * | 12/2008 | F41H 9/06 |

*Primary Examiner* — Jonathan C Weber
(74) *Attorney, Agent, or Firm* — Nelson Mullins Riley & Scarborough LLP; Anthony A. Laurentano

(57) ABSTRACT

A launcher comprising multiple barrels arranged on a rotatable plinth, each barrel configured such that its longitudinal axis can be moved through an arc from a first position where the axis is moveable through a plane substantially orthogonal to the plane in which the plinth and barrel assembly rotates to a second position and wherein one or more of the barrels can be moved independently of others carried on the plinth.

17 Claims, 4 Drawing Sheets

(56) References Cited

U.S. PATENT DOCUMENTS

| | | | | |
|---|---|---|---|---|
| 5,452,640 | A * | 9/1995 | Bovee et al. | 89/1.815 |
| 7,013,790 | B2 * | 3/2006 | Helms et al. | 89/38 |
| 7,150,218 | B2 * | 12/2006 | Berejnoi et al. | 89/37.22 |
| 7,237,468 | B2 * | 7/2007 | Laine | 89/37.05 |
| 7,509,910 | B1 * | 3/2009 | Nofsinger et al. | 102/361 |
| 2001/0015126 | A1 * | 8/2001 | Grunewald | 89/1.41 |
| 2005/0066806 | A1 * | 3/2005 | Helms et al. | 89/38 |
| 2005/0252368 | A1 * | 11/2005 | Berejnoi et al. | 89/37.01 |
| 2006/0288857 | A1 * | 12/2006 | Laine | 89/37.05 |
| 2010/0282150 | A1 * | 11/2010 | Onuk | 114/15 |

* cited by examiner

TRAINABLE LAUNCHER

RELATED APPLICATIONS

This application is a continuation of U.S. application Ser. No. 12/800,982, filed May 26, 2010, which is based upon and claims the benefit of priority from Great Britain Patent Applications No. 0913637.5 filed on Aug. 5, 2009 and No. 1004080.6 filed on Mar. 11, 2010, the contents of which are incorporated herein by reference.

BACKGROUND OF THE INVENTION

This invention relates to launchers used to fire projectiles from military and civilian plinths. In particular but not exclusively, the invention relates to a launcher used to fire countermeasure rounds off military ships. More particularly, the launcher is a trainable launcher configured to be adjustable for firing rounds in a range of arcs.

Trainable launchers are known. These consist of a bank of barrels on a base, the barrels are collectively trainable through an elevation arc and by rotation of the base can be trained through an azimuth arc in a plane orthogonal to the elevation arc.

One example of trainable launchers are the New Generation Dagaie System (NGDS). The NGDS is a NATO-compliant, flexible, self-defence electronic warfare unit based on decoy launchers and intended to counter multiple threats such as anti-ship missiles and torpedoes. With a mounting that can be elevated and traversed, the NGDS is integrated in the ship's combat system's detection and warning system. The system has been designed for integration onboard frigates but a lighter version is available for smaller ships (displacement below 1000 t).

A single NGDS system consists of two double-axis launchers each equipped with, for example 12 decoys on the common mounting and a computer that selects the best-suited countermeasure against a given threat. Against missiles the NGDS can employ both infrared and radar decoys and acoustic decoys or jammer against incoming torpedoes. The lighter version aimed at ships under 1,000 t only features a decoy launcher. So far, the NGDS have been selected for integration onboard the French Navy's La Fayette, Horizon and FREMM frigates.

Another example of a trainable launcher is the Rafael Integrated Decoy System (IDS). Whilst configured for different launcher layouts, the Rafael IDS is trained in much the same way as the NGDS.

Trainable launchers on warships need to strike a balance between meeting the requirement to fire as many rounds as possible, providing coverage over as wide a traverse and elevation range as ship safety will allow, minimising its deck footprint, meeting the required accuracy, and having a low centre of gravity and minimising weight.

As described, existing trainable launchers have two axes of freedom with an elevating structure containing all the rounds to be fired, supported through a trunnion arrangement onto a rotating plate. This results in high moments of inertia (MoI) when the launcher is required to align quickly to a new firing angle. This is compounded by significant out of balance forces which are prone to occur when countermeasure rounds are fired and an overall imbalance when they have left the launch tube. Consequently, large motors are needed to drive the launcher, the structure is heavy and its centre of gravity high. As the calibre, length and weight of the rounds increases, known trainable launcher designs for smaller calibres becomes impractical.

The present invention seeks to provide at economical cost, an effective, fully trainable launcher design suited to small and large calibre rounds alike.

SUMMARY OF THE INVENTION

In accordance with the present invention, there is provided a launcher comprising multiple barrels arranged on a rotatable plinth, each barrel configured such that its longitudinal axis can be moved through an arc from a first position where the axis is moveable through a plane substantially orthogonal to the plane in which the plinth and barrel assembly rotates to a second position and wherein one or more of the barrels can be moved independently of others carried on the plinth.

In another aspect the invention provides a launcher comprising multiple barrels arranged on a rotatable plinth, each barrel configured such that its longitudinal axis can be moved through an arc from a first position where the axis is moveable through a plane substantially orthogonal to the plane in which the plinth and barrel assembly rotates to a second position wherein the barrels are hinged at or near the rotatable plinth within about 20 cm of the plinth.

In another aspect the invention provides a launcher comprising multiple barrels arranged on a rotatable plinth, each barrel configured such that its longitudinal axis can be moved through an arc from a first position where the axis is moveable through a plane substantially orthogonal to the plane in which the plinth and barrel assembly rotates to a second position wherein the firing axis of all barrels is directed through the axis of the rotatable plinth.

The second and third aspects may advantageously be combined with the first stated invention and relate to practical embodiments thereof, but also may be beneficial when utilised independently of the first stated invention.

Desirably, each barrel is moveable independently of the others. Optionally combinations of barrels may be moveable as a group. Desirably the barrels can be selectively positioned at any one of a range of positions between the first and second position to provide a maximum range of arcs for firing the countermeasures.

Desirably the barrels are interchangeable allowing different barrels to be installed for different countermeasure requirements.

Preferably the launcher also includes a cover which is independently rotatable on the rotatable plinth, the cover including closable access means through which a selected barrel can be deployed. In use, the selected barrel and the access means are aligned through rotation of the plinth and/or the cover to a position from which the barrel is to be tilted. Once aligned, the access means is opened and the barrel deployed through the access means to the desired angle of elevation. Optionally, the access means may also be used to provide access to barrels for loading as well as countermeasure deployment.

In an alternative and simpler embodiment, a cover may be provided in the form of a fabric cover, for example made from canvas.

In one unique embodiment designed by the Applicant, the rounds are stored close together vertically near to the vertical rotational axis. This minimises the moment of inertia about the vertical axis and, as only the barrel to be fired is set to the required elevation angle, the Moment of Inertia about the horizontal axis is effectively eliminated. The resulting launcher has a low centre of gravity and generates weight savings over prior known trainable launcher designs. Further, the design will allow easy exchange of barrels to accommodate both old and new rounds.

The smaller footprint provided by the above described embodiment allows for a cover to be provided in the form of a rotating dome or other solid shape with minimal radar cross section to be fitted over the launcher. With apertures only open for firing and loading, significantly improved environmental protection is provided against sea spray, rain, snow, ice and solar radiation effects. The latter may contribute to longer operational life and higher reliability of performance for countermeasure rounds. The cover also reduces husbandry and maintenance, contributing to minimisation of through life costs. This will ensure radar cross section is minimised Loading would normally be on the inboard aspect (or forward and aft if there is limited space). The existence of the cover also prevents third parties easily gaining intelligence on the launcher load, an important consideration when operating close inshore.

As a result of the rotating cover, and the ability to set a particular barrel at the optimum angle for the operator, loading times are minimised. A further advantage the improved ergonomics of the system is reduced risk of operator injury.

Overall the unique design result is a practical solution allowing countermeasure rounds to be fired at the required optimised traverse training and elevation angle. This significantly increases the operational effectiveness of a countermeasures system and reduces the need for ship manoeuvre, one of the major operational shortcomings of fixed launcher systems.

BRIEF DESCRIPTION OF THE DRAWINGS

Figures of one embodiment of a launcher of the invention are attached.

DETAILED DESCRIPTION

Figure 1:
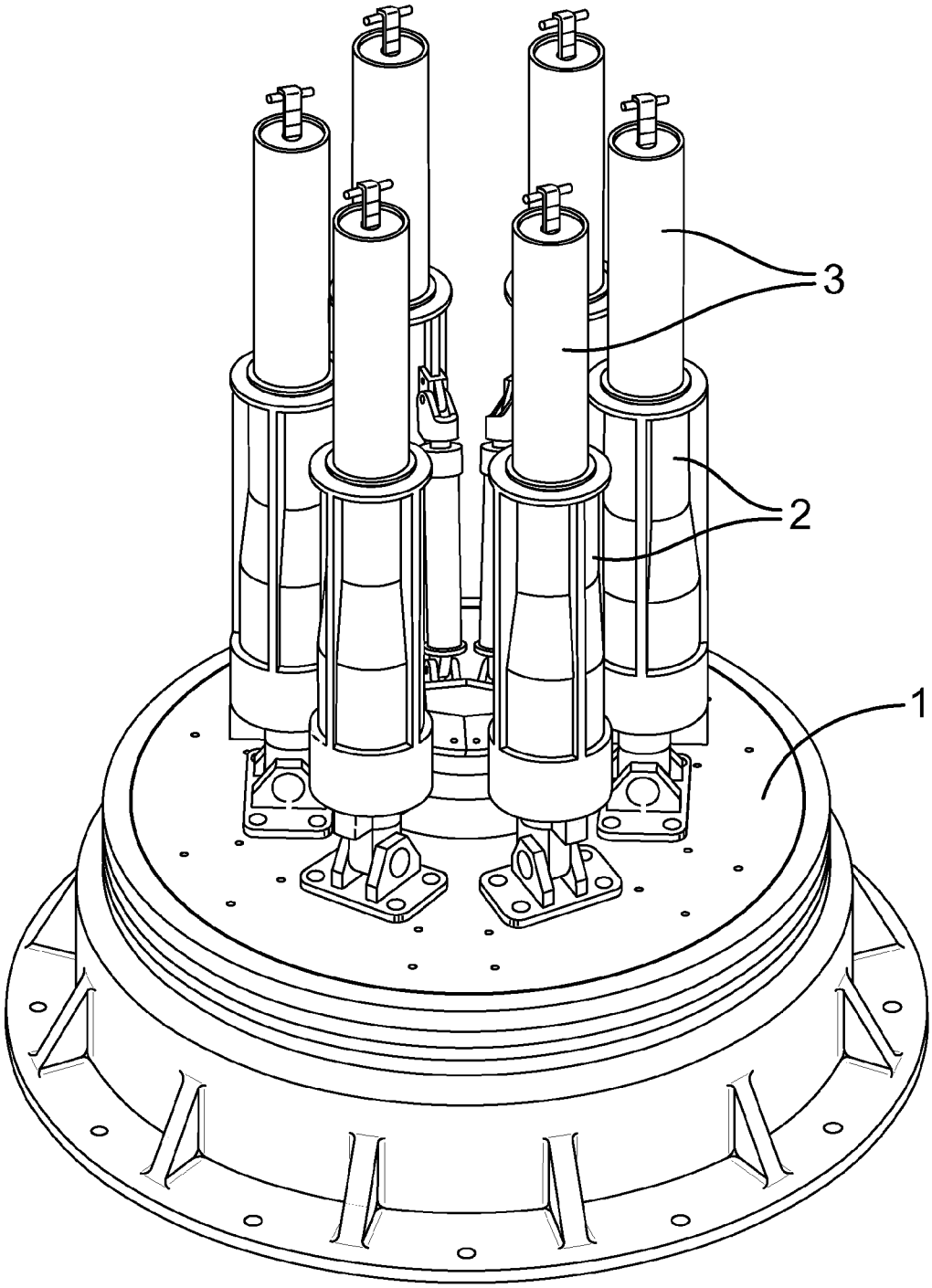
FIG. 1 is a perspective view of the launcher without a cover according to the teachings of the present invention.

FIG. 1 shows a launcher comprising a rotatable plinth 1 carrying multiple barrels 2 each configured to carry a countermeasure 3. The barrels are all presented in parallel alignment in the first position. It is to be noted that the barrels 2 are compactly packed around the centre of the circular, rotatable plinth 1.

Figure 2:
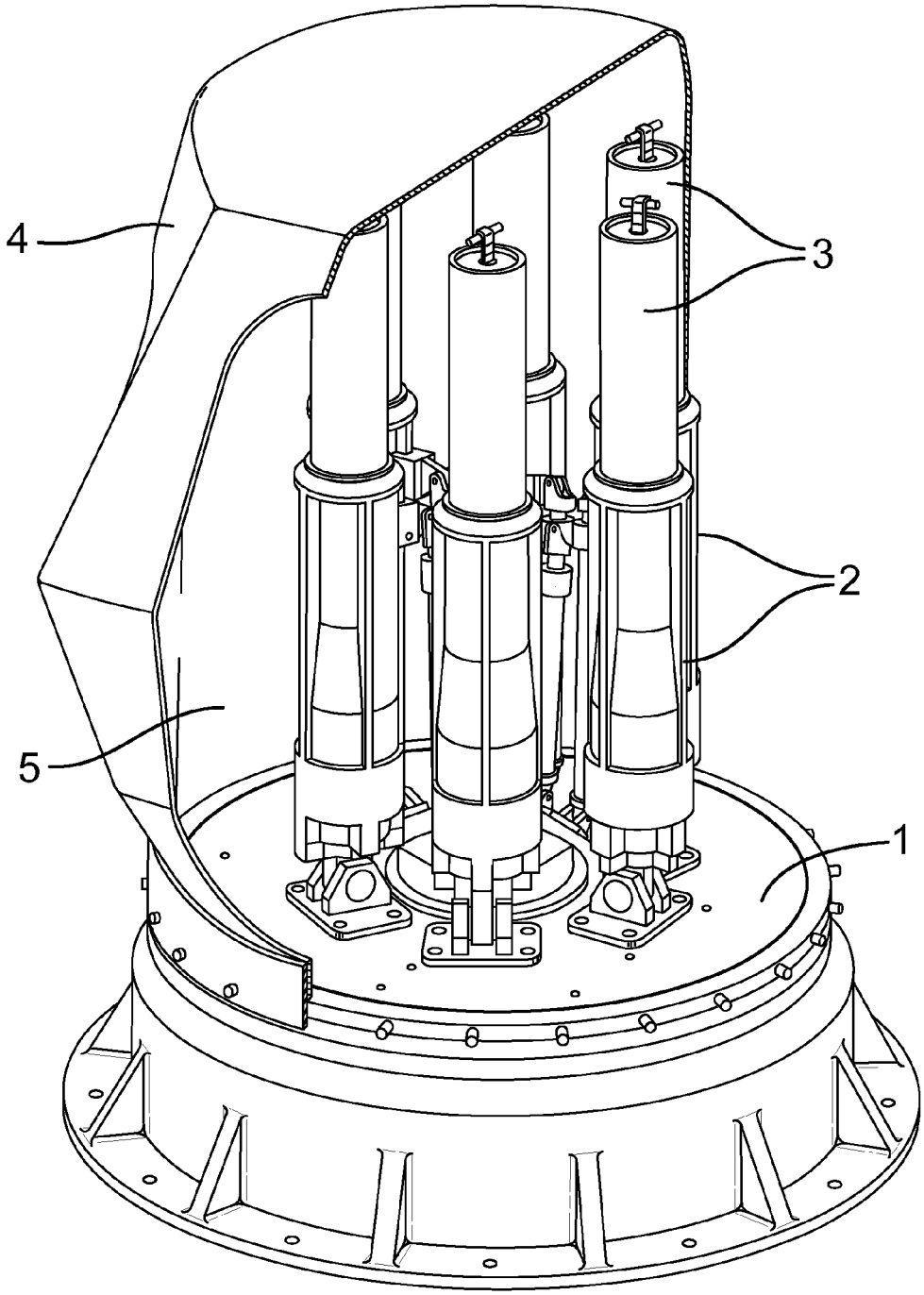
FIG. 2 is a perspective view of the launcher with the cover alternatively rotatably arranged on a plinth.

FIG. 2 shows the arrangement of FIG. 1 with a cover 4 arranged on bearings to be rotatable about the plinth 1. The cover is shown partially cut away but in practice would extend substantially entirely over the barrels. An access door 5 is also illustrated.

Figure 3:
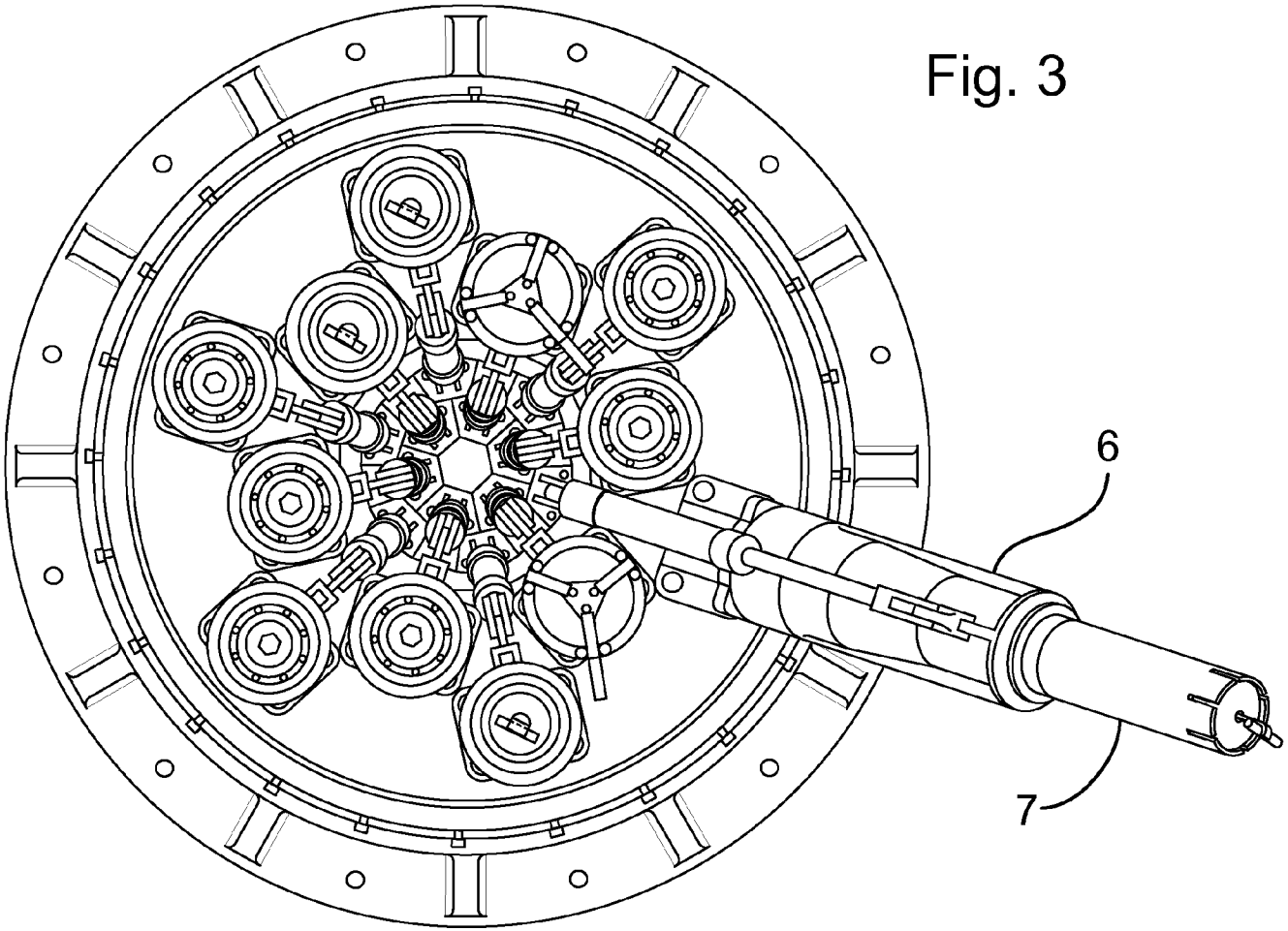
FIG. 3 is a top view of the launcher of FIGS. 1 and 2 with additional barrels, where one of the barrels 6 is moved to a second position according to the teachings of the present invention.
Figure 5:
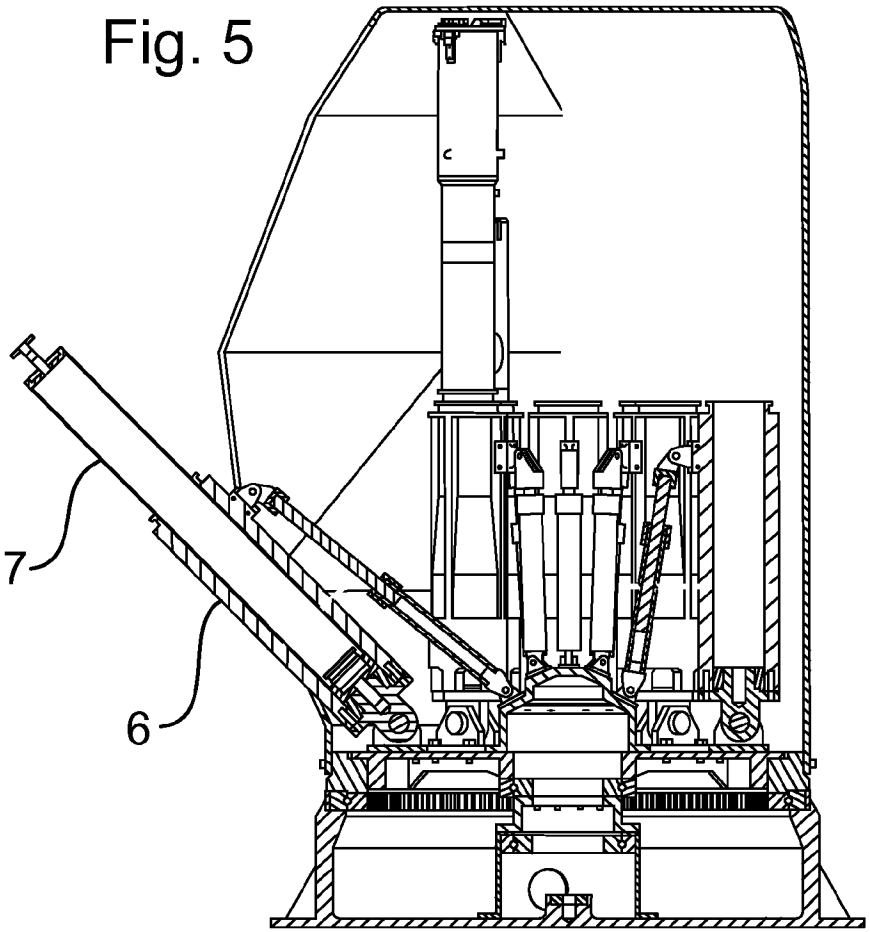
FIGS. 4 and 5 are cross-sectional views of the launcher of FIGS. 1-3 illustrating the use of different countermeasures according to the teaching of the present invention.
Figure 4:
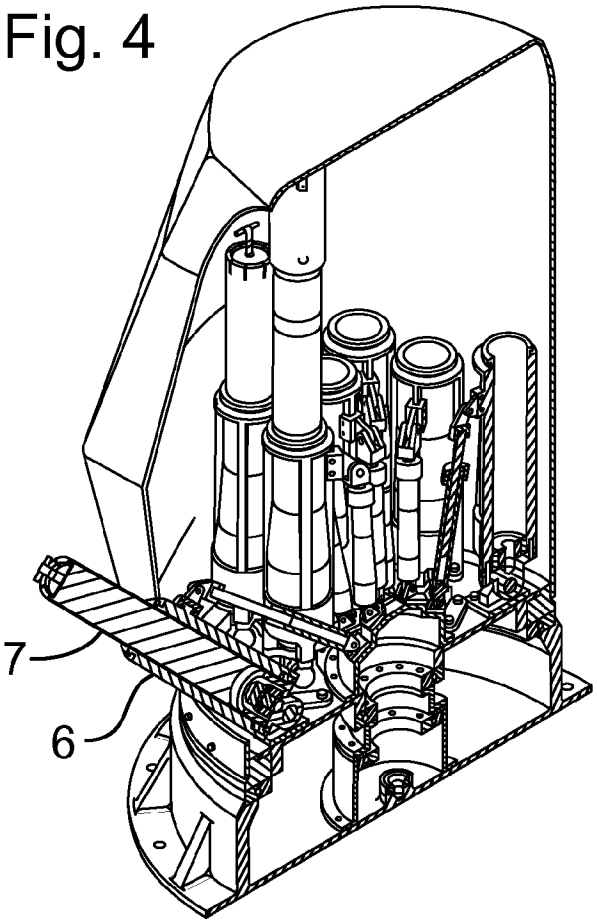

FIGS. 3, 4 and 5 show arrangements broadly similar to that of FIGS. 1 and 2 but carrying more barrels. FIGS. 3, 4 and 5 show one barrel 6 rotated to a second position ready to fire a countermeasure 7. FIG. 3 shows a top view of the embodiment with the cover removed. FIGS. 4 and 5 show a cross sectioned view of the embodiment. FIG. 4 is presented in a perspective view. As can be seen from FIGS. 4 and 5, the barrels can be provided with a variety of different countermeasures designed to address different threats.

It has been found that with the design and also contemplating modern day countermeasures, the barrels need not be solid in circumference but may be railed or otherwise discontinuous in circumference, this allows the launcher to be lighter and more responsive. It is envisaged that the proposed launcher can be adapted to carry a wide range of weight and calibre rounds including rounds of a calibre in excess of 130 mm.

The invention claimed is:

1. A launcher, comprising a plurality of barrels arranged on a rotatable plinth, wherein the plurality of barrels are vertically disposed in a normally stowed first position around a vertically oriented and centrally located rotation axis of the plinth, wherein a longitudinal axis of each of said barrels is substantially parallel to the rotational axis of the plinth when disposed in the normally stowed first position and moveable along an arc away from the centrally located rotational axis of the plinth from the stowed first position to a second position, and wherein one or more of the plurality of barrels is moveable independently of other barrels arranged on the plinth, and wherein at least two of the plurality of barrels are spaced at an equal distance from the axis of the plinth.

2. The launcher according to claim 1, wherein the plurality of barrels are hinged below a mid point of the longitudinal axis and proximal to the rotatable plinth.

3. The launcher according to claim 2, wherein the hinge is positioned within about 30 cm of the plinth.

4. The launcher according to claim 3, wherein the hinge is positioned within about 20 cm of the plinth.

5. The launcher according to claim 1, wherein a firing axis of said plurality of barrels is directed through an axis of the rotatable plinth.

6. The launcher according to claim 1, wherein each of said plurality of barrels is moveable independently of the other of said plurality of barrels.

7. The launcher according to claim 1, wherein combinations of said plurality of barrels are moveable as a group.

8. The launcher according to claim 1, wherein the plurality of barrels are selectively positionable at any one of a range of positions between the first and second positions to provide a maximum range of arcs for firing countermeasures.

9. The launcher according to claim 1, wherein the plurality of barrels are interchangeable allowing different barrels to be installed for different countermeasure requirements.

10. The launcher according to claim 1, wherein the launcher further includes a cover.

11. The launcher according to claim 10, wherein the cover is independently rotatable on the rotatable plinth.

12. The launcher according claim 10, wherein the cover comprises closable access means through which a selected barrel can be deployed.

13. The launcher according to claim 12, wherein the closable access means is configured to be used to provide access to barrels for loading as well as countermeasure deployment.

14. The launcher according to claim 10, wherein the cover is configured in a solid shape selected to have minimal radar cross section when fitted over the launcher.

15. The launcher according to claim 10, wherein the cover has a domed shape.

16. The launcher according to claim 10, wherein the cover is provided in the form of a fabric cover.

17. The launcher according to claim 1, wherein rounds to be launched are stored close together vertically near to the vertical rotational axis of the plinth.

* * * * *